United States Patent [19]

Horne, Jr. et al.

[11] 4,026,208

[45] May 31, 1977

[54] ROTARY PRINTING SCREEN HAVING HEAT-SHRUNK SUPPORT MEMBERS

[75] Inventors: Charles G. Horne, Jr., Charlotte, N.C.; Martin Sobel, Flemington, N.J.

[73] Assignee: Raylar Corporation, Charlotte, N.C.

[22] Filed: May 13, 1975

[21] Appl. No.: 577,000

Related U.S. Application Data

[63] Continuation-in-part of Ser. No. 417,979, Nov. 21, 1973, abandoned.

[52] U.S. Cl. ..... 101/116; 101/127.1; 101/128.1

[51] Int. Cl.[2] ..... B05C 17/06

[58] Field of Search ..... 101/127, 127.1, 128.1, 101/128.4, 116–120; 156/69, 84–86; 29/110, 123

[56] References Cited

UNITED STATES PATENTS

| | | | |
|---|---|---|---|
| 2,292,602 | 8/1942 | Biondi | 101/116 |
| 2,989,785 | 6/1961 | Stahl | 156/86 X |
| 3,481,805 | 12/1969 | Holmes et al. | 156/86 |
| 3,556,004 | 1/1971 | Mitter | 101/116 |
| 3,598,049 | 8/1971 | Dias | 101/127.1 X |
| 3,599,565 | 8/1971 | Feirer | 101/127.1 X |
| 3,608,482 | 9/1971 | Bubley | 101/127.1 |
| 3,710,531 | 1/1973 | Bielawski | 156/86 X |
| 3,792,562 | 2/1974 | Gilliam | 156/86 X |

OTHER PUBLICATIONS

"Inks, Equipment, and Screen-making Supplies", Colonial Catalog, 1970, p. 52.

*Primary Examiner*—Edward M. Coven
*Attorney, Agent, or Firm*—Depaoli & O'Brien

[57] ABSTRACT

A rotary printing screen, for mounting in a rotary screen printing machine, which has a support member at each end of its screen cylinder. The support member uniformly supports each endring against the longitudinal tension applied to the screen cylinder by the tensioning device so that the endrings remain in parallel. The support member, made from a heat-shrinkable plastic, such as polyethylene terephthalate, is selectively a heat-shrunk plastic sleeve or a heat-shrunk device endwise extension of the screen cylinder. Each embodiment extends over at least a portion of the shoulder of the endring to form a lip which has progressively greater thickness and decreasing circumference, terminating in a circular bead. As a sleeve, the support member fits over each terminal portion of the screen cylinder and covers its adhesive joint with the underlying cylindrical surface of the endring.

14 Claims, 8 Drawing Figures

FIG. 1
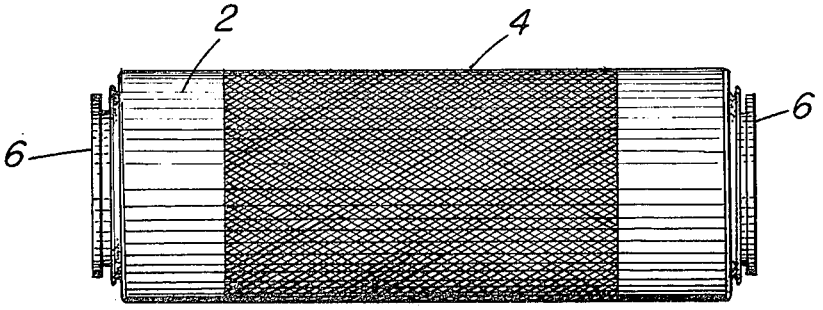
FIG. 3
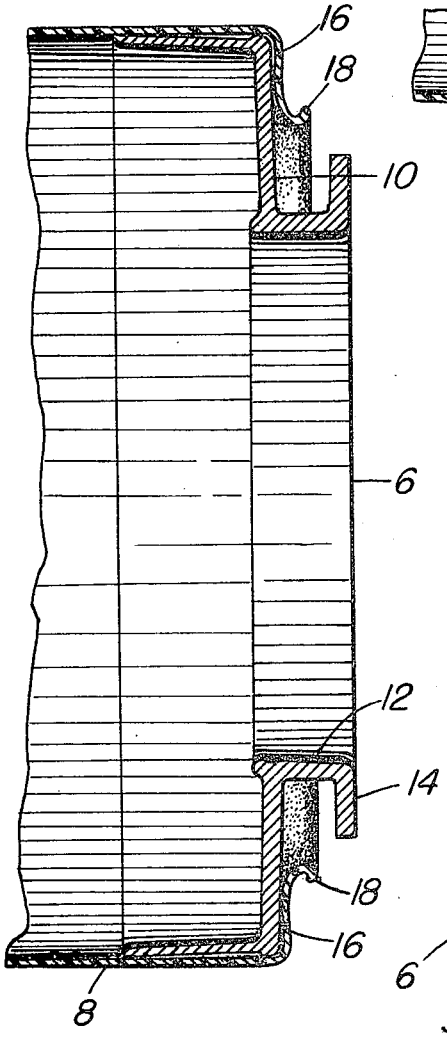
FIG. 2
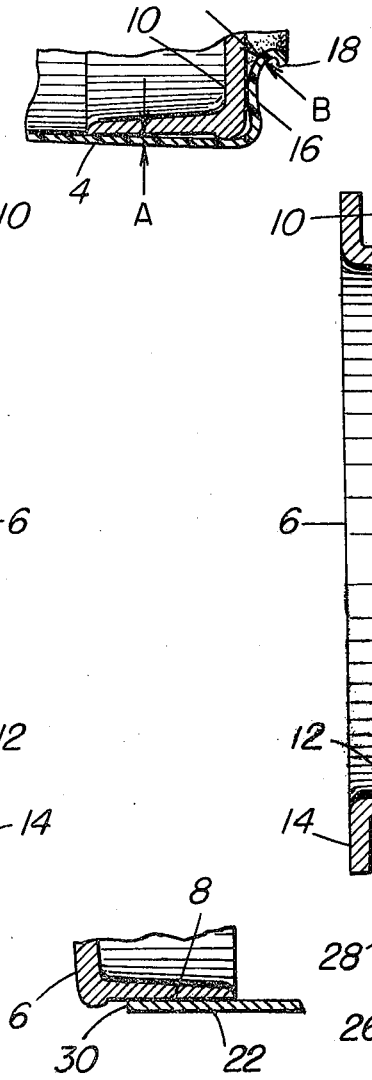
FIG. 4
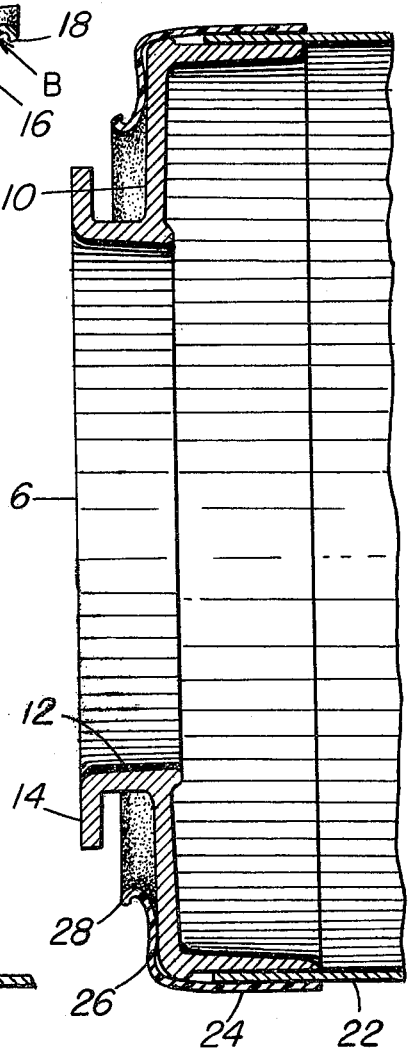
FIG. 5

ROTARY PRINTING SCREEN HAVING HEAT-SHRUNK SUPPORT MEMBERS

CROSS REFERENCE TO RELATED APPLICATION

This application is a continuation-in-part of U.S. patent application Ser. No. 417,979, filed Nov. 21, 1973, and now abandoned.

BACKGROUND OF THE INVENTION

1. Field of the Invention

This invention relates to a rotary screen printing machine. More particularly, it relates to a rotary screen for use therewith and especially relates to a device for uniformly supporting the end rings of the rotary screen against axially directed pressure of the longitudinal tensioning means therefor.

2. Review of the Prior Art

In recent years increasing interest has been focused upon rotary screen printing machines for use in textile printing. Due to the advances in the automation of textile production, there has been a growing need for a system to apply patterns to textiles both economically and at a high rate of production. Until recent years there were two main systems of applying patterns to textiles by printing, namely: (1) flat bed printing and (2) roller printing. While flat bed printing was relatively inexpensive, it was an inherently intermittent process which offered a rate of production much too slow to satisfy the textile industry. The rate of production of roller printing, however, represented a multiple increase over flat bed printing, which it essentially superseded. However, roller printing also represented higher costs and capitalization and thus a demand for longer runs. Consequently, with advances towards automation of textile production, there has been a growing need for a system of applying patterns to textiles which will not require the high capitalization, the vast runs of the roller printing machine, and the large amount of down time, all common to roller printing, and which will yet be appreciably faster than flat bed printing.

A process which apparently offers a solution to the foregoing problems and which is being increasingly accepted by industry is rotary screen printing. The apparatus utilized in such system comprises a perforated cylindrical or rotary screen which is utilized to apply colored designs to the textiles. The color applied is in the form of an emulsion or paste which is forced from the interior of the cylindrical or rotary screen through the perforations of the screen and onto the textile workpiece in a pattern according to the engraving of said cylindrical or rotary screen.

Generally, the screen per se is relatively thin, e.g., about 0.08 to 0.20 mm (about 0.003 to 0.008 inches). In operation, the colored emulsion or paste is passed from a reservoir inside the rotary screen by means of a squeegee which controls emulsion application, but it is the contact of the outer area of the screen on the textile substrate which determines the amount of pressure applied to the actual print.

The advantages of rotary screen printing vis-a-vis flat bed and roller printing are numerous. For example, in flat bed printing machines, the overlap between screens on a flat machine can easily cause smudges and crush the still-wet pattern of the adjacent but overlapped newly printed surface. Such defect will be evidenced as "cross-bars". Consequently, it is important that printing pastes be compounded so that they are absorbed by the fabric immediately on applicaton; otherwise, crushing is likely to result.

In addition, because of the relatively large area covered by a single screen brought into contact with the textile, there is a danger of such textile being lifted with the screen and torn away from the adhesive on the printing blanket of the flat bed. Such a problem is often encountered with lightweight synthetics. Consequently, a detrimental compromise must be made on the gauze of the screen in relation to the substrate: to use non-sticky printing pastes; and to use low-viscosity, rapidly absorbed pastes. Such a compromise results in loss of print sharpness, loss of brilliance, and loss of dyestuff development.

The advantages of rotary screen printing over roller printing reside in the fact that: (1) it is inevitable that color is taken from one roller to the next; (2) because of the high pressures which must be utilized in roller printing, the crushing of newly printed surfaces is virtually impossible to prevent; and (3) a much faster turnaround time is provided, i.e., time to change patterns on the printing machine. This results in the ancillary benefits of:

a. Reduced labor costs,
b. Overall productivity exceeding roller printing on short and medium length runs, and
c. Economical short runs.

The advantages of rotary screen printing compared with flat bed printing and roller printing are not only technological but are also evidenced by economic gains such as (1) the aforementioned improved productivity; (2) lower capital costs are required for the rotary screen due to low material cost, e.g., no copper inventory is needed; (3) the cost of screen engraving per se is about equal for rotary and flat screens and substantially less than that of engraving a copper roller; and (4) color consumption is minimal but without sacrifice of color yields which are relatively high.

While rotary printing evidences many advantages, certain problems are existent which are detrimental to the process. One such problem area is found with a rotary screen per se and the method of its fabrication. Heretofore, some of the earliest rotary screens were fabricated from phosphor bronze mesh, made first as a flat screen and then soldered at the repeat join to form a circular screen. The disadvantages of such screens, however, was in the soldered join and in the metal from which the screens were fabricated. Large open patterns and continual stripes could not be printed and the screens did not have a long life. Subsequently, woven circular bronze or stainless steel sleeves were also utilized, but these also presented difficulties in the usage and color application. An improvement was represented by the Galvano-plastic method which involved the electrolytic deposition of metal onto a matrix of steel which had previously been impressed with a specific number of dots corresponding to certain mesh sizes. The dots on the matrix were filled with a dielectric, and when the resulting matrix was entered into a plating bath a sheet was produced having perforations corresponding in size and number to the non-treated dots. Such rotary screens, however, often damaged easily and wore out quickly due to the corrosive action of the colored printing emulsions and pastes.

Another improvement was represented by the use of nickel. Nickel was eventually the metal chosen for deposition on the mesh since it is relatively inert to the chemicals encountered in the emulsions utilized. Another rotary screen developed was an all-metal screen fabricated by photographing the desired design image onto the circular matrix and depositing nickel thereon to a specifically defined thickness, the result being an all-metal sleeve containing the design and the necessary perforations. Both of the latter types of rotary screens, however, are also easily damaged, e.g., by corrosion, especially by acid dyes, or dented and the imperfections resulting therefrom show up in the resultant printing and are particularly unsatisfactory and costly, especially when such damage occurs during the peak of a long printing run. Another disadvantage inherent in the known rotary screens is the cost of fabricating the rotary screen per se because of the cost of preparation or engraving the screen, as well as the cost of the metal, e.g., nickel, utilized therein. There was, therefore, a bona fide need for an improved rotary screen fabricated from a material which overcomes the problems of damage or denting but which can be fabricated at relatively low cost.

Accordingly, co-pending Ser. No. 528,736, filed Nov. 4, 1974, relates to a precision plastic cylinder for use in the manufacture of an improved rotary printing screen for rotary screen printing. It also relates to a process for efficiently fabricating a substantially chemically inert, dimensionally stable precision plastic rotary screen from film, which rotary screen is advantageously utilizable in rotary screen printing processes and overcomes most, if not all, of the prior art deficiencies noted above. The plastic cylinders suitable for use as blanks in the preparation of rotary printing screens for use in rotary screen printing which are provided therein have critical dimensions and characteristics. The rotary cylinders are from about 48 inches to about 200 inches along the longitudinal length with a circumference of from about 18 to 78 inches. They are formed from a single sheet or a laminate sheet of essentially chemically inert, dimensionally stable film, such sheet or laminate being from about 0.002 to about 0.025 inch in thickness.

In fabrication, the sheet edges are preferably abutted so as to provide a join which precludes imperfections in the printed product when employed in rotary screen printing. A skewed join is advantageously employed to obtain a precise circumference of the cylinder. The joining of the sheet edges may be also done in the conventional manner, but ultrasonic sealing is preferred.

A rotary screen suitable for use in rotary screen printing operations is also contemplated therein and is produced by subjecting said plastic cylinder blank to a controlled energized beam, e.g., laser beam, of sufficient intensity to decompose the plastic material and form minute holes which extend through the cylinder.

While such plastic cylinders represent a technical advance of substantial merit, some problems are incurred when adapting them to practical use on rotary printing machines. In order to describe said problems, some attention must be given to the rotary machines per se with which the cylinders are to be utilized as well as to the techniques employed in their operation. Printing machines of the aforementioned type are usually equipped with a number of printing stations, each of which incorporates a respective rotary screen which rotates in synchronism with the backing cloth or printer's blanket which is situated beneath the material or fabric to be printed. Furthermore, beneath each rotary screen and below the printer's blanket there is arranged a counterpressure roller which supports the printer's blanket. Occasionally, each printing station employing a rotary screen is preceded or followed sequentially by one or more "crush" rollers. In all instances it is of extreme importance for the proper functioning of the rotary screen printing machine that the printing screens and the various rollers can be easily exchanged and/or adjusted at any time required. Additionally, the centering of the rotary printing screen must be as accurate as possible.

The rotary screen at each printing station is herein defined as comprising a screen cylinder, a pair of endrings, and a pair of support members. As mentioned, the screen cylinders are formed of very thin material having a thickness of only several thousandths of an inch. At the edges of these screen cylinders there are positioned endpieces or endrings by means of which the rotary screen unit can be centered and fastened to the printing machine.

In order to insure a frictionless working of the rotary screens in the printing machines, the thin-walled screen cylinder must be suitably attached in the machine and be tensioned in the axial or longitudinal direction. For this purpose, various tensioning devices are utilized which are arranged either inside the hollow screen cylinder or which are worked on the outside from the machine frame. U.S. Pat. No. 3,556,004 relates to one such device on rotary printing machines for exchangeably receiving and longitudinally tensioning rotary screens by connection of their endrings with rotary heads which are coordinated to the machine frame on both sides.

It is obvious that the longitudinal tension applied to the endrings and through the axis of the cylinder can be a cause of major concern. For example, even though the cylinder is held to the endring by adhesive means, the adhesive bond can be loosened at least in part, which can cause an off-centering or "cocking" of the endring relative to the cylinder. Such loosening or "cocking" can cause damage to the cylinder, e.g., by cracking, and to the workpiece textile as well. If the cylinder utilized is seamed in any fashion, such seam is especially vulnerable to the loosening or "cocking" of the endring. The loosening can also cause the entire removal of the endring with the resultant breakdown of at least that particular printing station.

SUMMARY OF THE INVENTION

It is, accordingly, an object of this invention to provide a screen cylinder which, in conjunction with endrings positioned at the ends thereof, is resistant to the longitudinal tension and other stresses applied in rotary printing machines.

It is an additional object of this invention to provide a process for manufacturing a screen cylinder which is resistant to the longitudinal tension and other stresses applied to the endrings positioned therein.

It is another object to provide a heat-shrunk support member which is selectively an endwise extension of a screen cylinder or a sleeve that overlies a terminal portion of a cylinder and protects the adhesive joint between the terminal portion and the cylindrical surface therebeneath of an endring.

The rotary screen of the invention generally comprises a pair of endrings, a screen cylinder, and a pair of heat-shrunk support members. Each endring has a central rotational axis, an outer cylindrical surface, and an adjacent radially disposed shoulder extending from the cylindrical surface toward the axis. The endrings are mutually parallel, coaxially disposed, and axially spaced within the thin-walled screen cylinder which is coaxially aligned with the central rotational axis and which has a central perforated portion and a terminal portion at each end thereof. Each terminal portion extends over, and is preferably adhesively bonded to, the outer cylindrical surface of one of the endrings, thus forming an adhesive joint therebetween.

Each support member extends from one of the cylindrical surfaces and over at least a portion of the adjacent shoulder toward the axis and is heat shrunk as a circular lip into tight contact with the endwise outer surface of the adjacent shoulder, thus progressively decreasing in circumference and increasing in thickness with distance from the cylindrical surface, so that the support members uniformly resist the axially directed outward pressure created by the longitudinal tensioning means of the rotary screen printing machine and support the endrings against being pulled out of the cylinder and against being cocked out of parallelism. Each lip preferably terminates in a circular bead.

The support members are selectively in either of two embodiments: a separate sleeve or an endwise extension of the screen cylinder. As a sleeve, the support member fits over one of the terminal portions of the cylinder and protects the adhesive joint therebeneath. As an endwise extension, each support member is an integral part of the cylinder and, before heat shrinking takes place, it is simply a cylindrical endwise extension of the adjacent terminal portion.

In the sleeve embodiment, the cylinder and the sleeves are selectively formed of different materials, the cylinder for example, being satisfactorily formed from metal. In the endwise extension embodiment, both the cylinder and the endwise extensions must necessarily be made from the same material. The support member, whether a separate overlying sleeve or an endwise extension, must always be made from a heat-shrinkable plastic, preferably polyethylene terephthalate.

The advantages of the invention are attributable to the fact that each terminal portion of the cylindrical member not only concentrically covers the outer cylindrical surface of said endring but extends over the shoulder of said endring as an endwise extension which, after it has been heat shrunk, terminates with a diameter substantially less than the diameter of that portion of the plastic cylinder covering the cylindrical surface of said endring and so that it forms a lip about the shoulder of the endring. That heat-shrunk portion of the plastic screen cylinder extending over the shoulder of the endring and having a smaller diameter is preferably thicker than the remainder of the hollow plastic screen cylinder. It is also preferred that each terminal edge of the plastic screen cylinder is beaded so as to provide an extremely tough durable edge to the lipped portion.

The cylinder utilized comprises a single sheet of thin plastic film (e.g., 0.002 to 0.025 inch in thickness) although a laminated sheet of thin plastic film is also contemplated. The sheet of thin plastic film utilized should be prepared from organic polymers and/or copolymers which are substantially inert to the printing emulsions or paste utilized in the processes. It is critical that heat-shrinkable polymeric materials are utilized in order to be able to reduce the diameter of the cylinder extending over the shoulder of the endring and form the desired thickened lip and bead. A preferred class of materials are polyesters, copolymers of polyesters and the like, especially polyethylene terephthalate, although other polymers may be utilized if found suitable.

Preparation of the lipped portion of the plastic screen cylinder about the endring is deemed critical and involves heat shrinking said cylinder on the endring utilizing critical operating conditions. Basically, such shrinking process comprises uniformly trimming each terminal portion of the hollow plastic cylinder; positioning an endring in each terminal end of the cylinder and adjusting said endring and cylinder so as to provide a specific length overhang of the plastic cylinder relative to the shoulder of the endring and rotating the cylinder and endrings while heating the terminal portion of said overhang under critical conditions. Such heating is important so as to impart the desired shrinking characteristics, i.e., from the thickened lip and beaded edge, and yet avoid embrittling or melting the plastic polymer material of the plastic cylinder.

While the present invention is primarily directed to a hollow plastic screen cylinder used in conjunction with endrings, it also contemplates a hollow plastic cylindrical sleeve which is used in conjunction with a metal roller or screen cylinder and which covers the joint between the metal cylinder utilized and the endrings positioned at the terminal ends thereof. Such sleeve protectively covers the vulnerable joint and, in a manner similar to the foregoing embodiment, is heat shrunk so that it extends axially over the shoulder of the endring and terminates in a portion having a diameter smaller than the cylindrical surface of the endring and so that it forms a lip about the shoulder of said endring.

In each of the above embodiments, adhesive means may be utilized to adhere the plastic cylinder to an endring or to adhere the plastic sleeve to a metal cylinder/endring combination. Adhesive means may also be utilized in the construction of the metal cylinder/endring combination itself. While each endring is usually joined to the cylinder by adhesive means to prevent rotation of the endring relative to the cylinder, such heat shrinking also prevents failure of the adhesive and consequently undesirable rotation.

There are a plurality of advantages emanating from the instant invention. For example, the heat-shrunk lip increases the strength of the terminal end of the cylinder per se, particularly the seam of such cylinder, making it more durable. The heat-shrunk lip also holds the endring when the rotary screen is subjected to the longitudinal tension applied by the tensioning device of the printing machine, i.e., it serves as a positive means to support the adjacent endring in order to prevent cocking of the endring within the cylinder and to prevent the endring from being pulled out of the cylinder.

The tensioning device creates axially directed pressure that tends to pull the endrings apart while longitudinally tensioning the perforated central portion of the thin-walled screen cylinder between the pair of endrings. By being heat shrunk into tight contact with at least a portion of the endwise outer surface of the adjacent shoulders, the support members uniformly resist this pressure and maintain the endrings in parallel.

As used herein, the term "film" signifies any extruded plastic web having a thickness sufficiently thin to allow passage of a printing emulsion or paste through minute holes therein. Generally, such thickness is about 0.025 inch or less depending on the characteristics of the plastic, emulsion or paste and operation parameters utilized.

As used herein, the term "plastic cylinder" or "plastic cylinder blank" signifies an endless web formed from heat-shrinkable polymeric film and of such dimensions and having such dimensional stability and chemical inertness to printing emulsions and pastes so as to make such article suitable for use for fabrication into a rotary printing screen or roller.

As used herein, the term "plastic rotary screen blank" or "roller" signifies an article comprised of a "plastic cylinder" or "plastic cylinder blank" which has endpieces or endrings positioned at each terminal end thereof and which is suitable for use in the fabrication of a rotary printing screen.

As used herein, the term "plastic rotary printing screen" signifies an article fabricated from a "plastic cylinder" or "plastic cylinder blank" and which has a design or pattern of perforations introduced therein and which is of such dimensional stability and chemical inertness to printing emulsions and pastes that it is suitable for use as a rotary screen in rotary screen printing and which has endpieces or endrings positioned at each terminal end of said cylinder.

As used herein, the term "roller" signifies a counterpressure roller which is positioned beneath a rotary printing screen and which may support the printer's blanket; a crush roller which can sequentially precede or follow one or more rotary printing screens; or any other type of roller which is adaptable to a textile printing application. Said roller can be fabricated from a "plastic cylinder blank" and has endpieces or endrings positioned at each terminal end of said cylinder.

DISCUSSION OF THE DRAWINGS

FIG. 1 illustrates a side view, partly in section, of a plastic rotary screen of the present invention.

FIG. 2 illustrates a fragmentary sectional view of FIG. 1.

FIG. 3 illustrates a vertical section of an endring having a rotary screen cylinder attached thereto in accordance with the present invention.

FIG. 4 illustrates an embodiment of the instant invention wherein a plastic cylindrical sleeve is positioned about a rotary screen.

FIG. 5 illustrates a fragmentary sectional view of FIG. 4.

Figure 6:
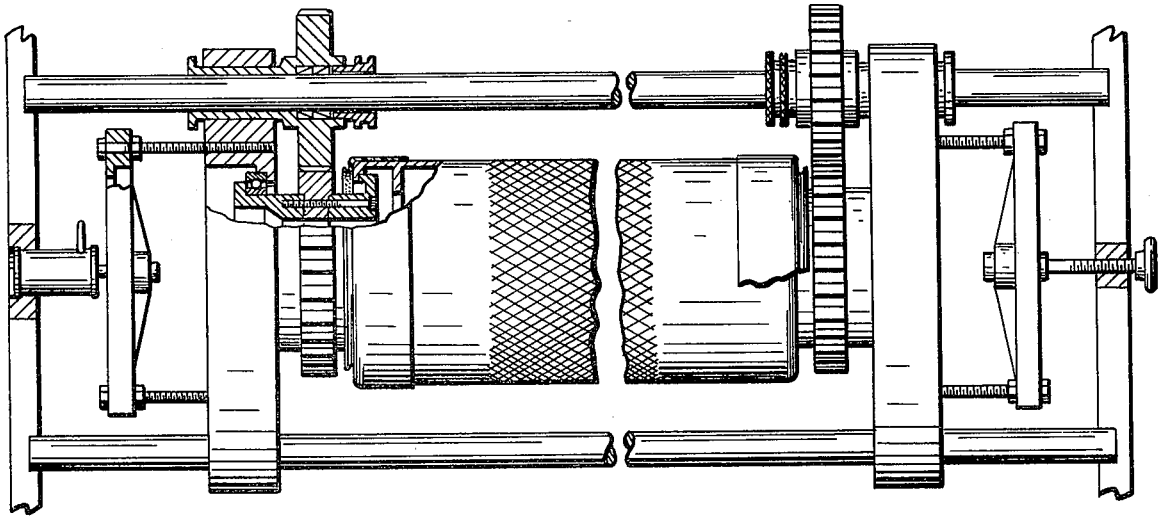

FIG. 6 represents a printing station of the prior art as shown in FIG. 4 of U.S. Pat. No. 3,556,004, wherein a rotary printing screen, comprising a pair of endrings and a screen cylinder, is longitudinally tensioned by a tensioning device including a pair of support tubes which are suitably connected to the machine frame, a heat-shrunk support member of this invention being radially recessed over each endring and the adjacent terminal portion of the cylinder as a plastic cylindrical sleeve.

Figure 7:
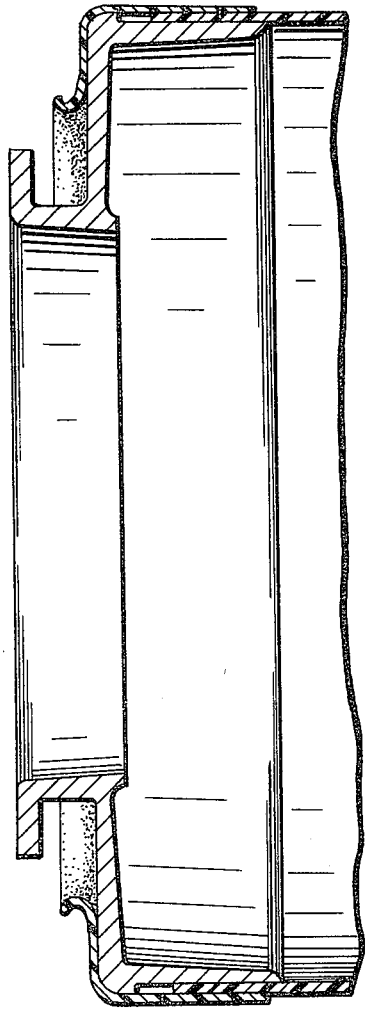

FIG. 7 illustrates a fragmentary detailed view of of one plastic cylindrical sleeve, the adjacent endring, and the adjacent cylinder end, as in FIG. 5 of U.S. Pat. No. 3,556,004.

Figure 8:
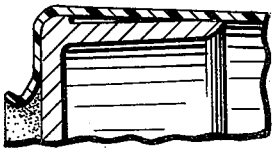

FIG. 8 illustrates a fragmentary sectional view, similar to FIG. 7, with the heat-shrunk support member being an endwise extension of the cylinder.

With reference to FIGS. 1–3, numeral 2 designates a rotary printing screen which, in this embodiment, is formed from a perforated plastic cylinder 4. Endpieces or endrings 6 are secured to the terminal portions of the plastic cylinder 4. Each endring 6 comprises an outer cylindrical surface 8 about which the screen cylinder 4 is positioned, an adjacent radially disposed shoulder 10 which extends radially inwardly to machine connecting means, an adjacent axially disposed projection 12 and an adjacent radially disposed ring disc 14, perpendicular to the axis of the cylinder 4, which radially projects outwardly from said projection 12 and from the axis of the cylinder screen 4 and which forms the connecting means by which said endrings are positioned and secured in a rotary screen printing machine (not shown). A longitudinal tensioning or stretching device which is suitable for use with the endrings of the rotary screens of this invention is shown in FIG. 4 of U.S. Pat. No. 3,556,004 when connected to rotary heads which are revolvably mounted in the bearing body, as shown in FIGS. 5–8, by means of an axially elastic ring which fits over each ring disc.

While endpieces or endrings 6 are adhesively bonded to cylinder 4 by means of their cylindrical surface 8 within the associated cylindrical plastic printing screen, as mentioned, it is quite difficult to position and maintain said endrings 6 within the printing cylinders of the prior art, especially when longitudinal force or tension is exerted against ring disc 14, when the rotary screen or roller 2 is placed in the printing machine. Consequently the circumferentially uniform support which is provided by the strong and closely fitting support members of this invention greatly facilitates the manufacture of rotary screens.

In accordance with the present invention, said plastic cylinder extends in its unshrunk condition from about 0.1 to 1.5 inch, preferably from about 0.25 to 0.75 inch, past the cylindrical surface 8 of the endring 6 and, by means of the process of the present invention, is heat shrunk about the endwise outer surface of the shoulder 10 of the endring 6 so as to form a lip 16. Usually the plastic film of which the cylinder is comprised is shrunk from about 5 to 40 percent, preferably 10 to 35 percent, in axial length. Thus, the heat-shrunk lip 16 desirably extends over the shoulder 10 of the endring 6 from about 0.1 to 1.0 inch. This plastic film is also shrunk from about 2.5 to 15 percent, preferably 5 to 10 percent, in circumference so as to form the necessary lip. Also in accordance with the invention, lip 16 is so formed so as to have a bead 18 at the end thereof so as to impart the desirable characteristics referred to herein. As hereinabove described, the plastic film from which the cylinder of the instant invention is fabricated is generally from 0.002 to 0.025 inch thick and is preferably from 0.005 to 0.014 inch thick. This thickness is indicated at "A" in the fragmentary view of FIG. 2. In accordance with the present invention, the heating of the terminal portion of the cylinder results in lip 16 having a thickness thicker than the usual section "A" and, as illustrated at "B" in FIG. 2, ranges from about 10 to 90 percent and preferably from about 20 to 40 percent greater than the thickness indicated at "A".

FIG. 4 illustrates an embodiment wherein a plastic cylindrical sleeve 24 is used in conjunction with a metal rotary printing screen or roller. Accordingly, the metal rotary printing screen or roller comprises a metal screen cylinder or cylinder blank 22 and an endring or endpiece 6 positioned within each terminal end thereof. The endring 6 may be similar to the embodiment of the present invention shown in FIGS. 3 and 4 and is shown as also comprising an outer cylindrical surface 8, an adjacent radially disposed and inwardly extending shoulder 10, an adjacent axially disposed projection 12, and an adjacent radially disposed and outwardly extending ring disc 14. The endring 6 is secured within the screen cylinder or blank 22 by adhesive means applied between the inner surface of said screen cylinder or blank 22 and the outer cylindrical surface 8 of endring 6.

FIG. 5 illustrates an enlarged fragmentary sectional view of the joint or seam 30 resulting from the positioning of the endring 6 within the screen cylinder or blank 22 and without provision of the overhang or lip of the present invention. Such joint is clearly vulnerable to any cocking of the endring which can result in tearing and ultimate failure of the screen cylinder or blank. In addition, the joint itself is undesirable as any sharpness or projection caused by the cylinder edge can cause marking or worse damage to any textile or printer's blanket with which it comes in contact, especially when a metal cylinder is employed.

Accordingly, sleeve 24 is provided with a lip 26 and a beaded edge 28 which has been heat shrunk around the terminal ends of the printing screen or roller. Sleeve 24 is thus positioned securely about the terminal portion of the cylinder 22 so as to protectively cover the joint 30 and to extend over the shoulder 10 of the endring 6 as in other embodiments and in order to enhance the attachment of the cylinder 22 to endring 6.

In general, the parameters of the sleeve of this embodiment coincide with those corresponding in the embodiment set forth hereinabove except its axial length. Such sleeve can be adjusted as desired, but it must be of sufficient axial length to cover the joint or seam 30. Usually a sleeve about 6 inches in length or less will suffice.

FIGS. 6–8 illustrate a rotary printing screen of this invention as it is mounted in one printing station of a rotary screen printing machine of the prior art, the support members of the invention being shown in FIGS. 7 and 8 respectively as a heat-shrunk sleeve covering the adhesive joint at one end of the screen cylinder and as a heat-shrunk endwise extension of the screen cylinder, each screen cylinder in FIGS. 6–8 being longitudinally tensioned by the externally mounted tensioning device which is attached to the machine frame.

DESCRIPTION OF PREFERRED EMBODIMENTS

The present invention contemplates the use of any heat-shrinkable plastic or polymeric film materials which also exhibit satisfactory dimensional stability and chemical inertness to printing emulsions and pastes so as to make the film suitable for use in the fabrication of a rotary printing screen or roller.

A heat-shrinkable film, as employed herein, is one in which the strains in a plastic or polymeric film are released by raising the temperature of the film, thus causing it to shrink. These shrink characteristics are built into the film during its manufacture by stretching it under controlled temperatures to produce orientation, q.v., of the molecules. Upon cooling while under restraint, the film retains its stretched condition, but subsequently reverts toward its more random original dimensions when it is heated.

A film which exhibits satisfactory dimensional stability and chemical inertness may be chosen from a broad spectrum of candidate materials. The necessary characteristics and properties are ascertainable by art-recognized tests and analyses. Thus, a suitable film candidate could be chosen from an array of polymeric material which may include, by way of example, polyesters such as polyethylene terephthalate, polyolefins such as polyethylene and polypropylene, polyethers such as polyoxymethylene, vinyl acetate polymers and copolymers, polyamides such as polyhexamethylene adipamide and polycaprolactam, acrylic resins such as polymethylmethacrylate and methyl methacrylate, halogenated polymers such as polyvinyl chloride, polyvinylidene chloride, tetrafluoroethylene, hexafluoropropylene and the like, polyurethanes, cellulose esters of acetic acid, propionic acid, butyric acid and the like, polyacetal resins, styrene polymers and copolymers, rubber hydrochlorides, polycarbonates and the like. The important criterion is that the film exhibit the required characteristics and properties referred to above.

As hereinbefore described, the plastic cylinders utilized in the present invention are especially adaptable to thermoplastic polyesters, copolymers of polyester and especially to polyethylene terephthalate, due to the desirable properties evidenced by said polymers. Polymers evidencing all the properties and advantages of polyesters are also contemplated.

Suitable polyester sheet or film materials which may be used in the present invention are formed from condensation products of a bi-functional dicarboxylic acid and a dihydric alcohol and possess dimensional stability at elevated temperatures. The preferred condensation products are formed with aromatic dicarboxylic acids; however, products formed with dicarboxylic acids such as adipic, sebacic, etc. are likewise acceptable. For instance, such polyesters may be of the type described in Carothers U.S. Pat. No. 2,071,250. The polyesters may be composed of any of the high-melting, difficulty soluble, usually micro-crystalline, cold-drawing, linear, highly polymerized esters of terephthalic acid and glycols of the series.

$$HO(CH_2)_nOH$$

wherein $n$ is an integer within the range of 2 to 10, described in Whinfield et al., U.S. Pat. No. 2,465,319. The particularly preferred polyester is polyethylene terephthalate.

However, the polyesters used in accordance with the present invention need not consist solely of dicarboxylic acid and simple glycol units since some of the glycol units may react to form polyglycols, and small percentages of such polyglycol units may also be present. For instance, when ethylene glycol is a reactant, the polyester may contain from 1 to 15 percent by weight of diethylene glycol units, i.e., $—CH_2CH_2OCH_2CH_2O—$.

Also contemplated are blends of suitable polyesters, such as blends of polyethylene terephthalate of different molecular weights or blends of a polyethylene terephthalate with a polybutylene terephthalate as well as blends of a suitable polyester with any polymer where the distinguishing advantageous characteristics of the polyester are retained.

Preferably, the polyester which is utilized in the process is a heat stable highly polymeric linear polyethylene terephthalate sheet which has been biaxially oriented and heat set to provide improved dimensional stability, such as described in Alles U.S. Pat. No. 2,779,684.

As indicated, it is essential that the polymers utilized evidence a plurality of suitable characteristics and properties in addition to the necessary characteristic of heat shrinkability, i.e., up to 20 percent its original length and preferably about 5 to 10 percent its original length. Table I sets forth typically desired values for certain properties and characteristics of polymers which are useful in this invention.

TABLE I

| PROPERTY | CHARACTERISTICS |
|---|---|
| Machinability | Excellent general and laser machinability |
| Tensile strength | 25,000 psi (ultimate); 15,000 psi (5% elongation) |
| Tensile modulus | 555,000 psi |
| Thermal expansion | $1.7 \times 10^{-5}$ inch/inch/° C. |
| Water absorption | Less than 0.8% (on 24 hour immersion at 23° C.) |
| Chemical Resistance | |
| Weak acids | Good to high resistance |
| Strong acids | Good to high resistance |
| Weak alkalies | Good to high resistance |
| Strong alkalies | Good to high resistance |
| Organic solvents | Good to high resistance |

The sheets of film utilized herein are available as commercial products. The single sheet thickness of the film may suitably range from about 0.001 to about 0.025 inch prior to fabrication but single sheet thicknesses of 0.005 to 0.014 inch are generally employed, with 0.007 to 0.010 inch being preferred. One suitable film is duPont, Type "S" Mylar industrial polyester film.

In accordance with the process of the present invention, the preparation of the lipped portion of the plastic cylinder about the endring or endpiece involves heat shrinking each terminal portion of said cylinder on an endring, utilizing critical operating parameters. Broadly, the shrinking process comprises uniformly trimming each terminal portion of the heat-shrinkable plastic cylinder positioning an endring in each terminal portion of said cylinder and adjusting said endring and cylinder so as to ensure concentric sleeving and so as to provide a specific overhang of the plastic cylinder relative to the shoulder of the endring. The combination of cylinder and endrings are then rotated while heat is applied according to a profile so as to provide proper shrinkage of the overhanging portion of the plastic cylinder about the shoulder of the endring. Profile is herein defined as heat distribution in the heated film overhang so that its hottest part is its terminal edge or no more than 0.3 inch inwardly therefrom. It is important that the heating operation imparts desired shrinking characteristics and yet avoids embrittling or melting of the polymer material of the cylinder.

It is important that the end cut of the cylinder be sufficiently uniform so as to insure a desirable heat shrink as a non-uniform cut results in a non-uniform shrink. The end cut of the cylinder, therefore, is machine cut. Suitably, either a laser cut or a razor edge cut may be employed.

It has been found that the overhang of the plastic cylinder relative to the shoulder of the endring should be from about 0.1 to 1.5 inch, preferably from about 0.25 to 0.75 inch. It has been found that the shorter overhangs do not develop the proper temperature profile upon application of heat while longer overhangs require more shrinkage than can be effected without embrittling or melting of the polymer material.

It has been found that both the rotation and the heat source position are interrelated and are extremely critical for heat shrinking, especially when metal endrings are utilized. With regard to rotation, the rate is usually from about 50 to 1000 rpm with a rotation rate of about 200 to 500 rpm being preferred. The rotation rate is, in part, predicated on the heat dissipation characteristics of the endrings utilized. Thus, the greater the heat dissipation of the endrings, the higher the rotation rate required. Thus, endrings having a larger mass and a larger surface which can dissipate heat must be rotated at a higher rate than endrings with a smaller mass and a smaller area. Similarly, metal endrings, e.g., aluminum, can dissipate heat quicker than plastic endrings; consequently, metal endrings must be rotated at a higher rate than plastic endrings.

With regard to the heat source, any heat source is suitable which can attain the desired temperature range and apply the desired temperature to the plastic overhang in the desired profile. One such heat source is a propane gas torch adjusted to a flame which is not too high so as to cause the polymer to overheat and embrittle nor too low so as to allow the endrings to dissipate heat too rapidly and thereby to preclude attaining the proper temperature of the plastic for its shrinkage. It is important not to subject the plastic to too long a period of heat, even at a lower temperature, as such application of heat will also cause embrittlement. It is also critical that the heat is applied in a profile, that is, the heat must be applied so that the film overhang is at its hottest at or nearly at the terminal edge thereof, i.e., at the edge or no more than about 0.3 inch inwardly from said edge, so as to impart the greatest amount of shrink and also to form the desired beaded edge. Less heat is derived from the heat source as the distance measured approaches the endring. Similarly, the heat profile must be uniform so that the distance between the heat source and the shoulder of the desired lip is concommitantly uniformly formed. Generally, the heat source remains stationary in order to impart the desired temperature profile, but with reasonable experimentation the heat source may be moved either further or nearer to the workpiece or along its longitudinal surface in order to impart the ultimate shrinkage parameters.

The following Example will serve to illustrate the invention further.

EXAMPLE

In order to illustrate suitable operating conditions for heat shrinking a plastic cylinder on a variety of endrings, three different types of endrings were employed. Each endring was manufactured by a different corporation, namely: (1) Johannes Zimmer Maschinenfabrik of Klagenfurt, Austria; (2) Peter Zimmer Maschinenfabrik of Kufstein, Austria; and (3) Bercen Chemical Co., Inc. of Providence, Rhode Island for the printing machine manufactured by Stork-Brabant N.V. of Boxmeer, Netherlands.

The film employed was 7-mil Mylar, a polyethylene terephthalate film commercially available from the duPont Corporation. The longitudinal axis of the printing cylinder was in the machine direction of the film and the circumference thereof was in the transverse direction.

Table 2 sets forth the operating conditions utilized.

TABLE 2

| OPERATING CONDITIONS | |
|---|---|
| Heat Source: | Propane gas torch, medium flame |

TABLE 2-continued

| OPERATING CONDITIONS | | | |
|---|---|---|---|
| Cylinder End Cut: | Machine Razor Cut | | |
| Torch Position: | (a) 1.5 inches from the under surface of the film workpiece (end of the flame inner cone). (b) 0.3 inch from the endring shoulder edge. (c) 90° or perpendicular to film workpiece. | | |
| Film Overhang: | 0.45 inch | | |
| Printing Machine Type: | (1) J. Zimmer | (2) P. Zimmer | (3) Stork (Bercen) |
| Endring Diameter: | 25.23 in. | 25.23 in. | 25.23 in. |
| Endring Material: | Aluminum | Aluminum | Polyester |
| Rotation Rate: | 200 rpm | 550 rpm | 200 rpm |

A pair of the Johannes Zimmer endrings, when combined with a screen cylinder and supported against longitudinal tensioning according to the process of this invention to form a rotary screen, is attached to the machine frame of a rotary screen printing machine by means of rotary heads which are revolvably mounted in bearing bodies with axially elastic rings, cup springs, and clamping screws, as shown and described in U.S. Pat. No. 3,556,004.

A pair of the Peter Zimmer endrings, when combined with a screen cylinder and supported against longitudinal tensioning according to the process of this invention to form a rotary screen, is attached to the frame of a rotary screen printing machine by means of screen holders bearing against the ring discs of the end pieces, as shown and described in U.S. Pat. No. 3,585,930.

The physical dimensions of a heat-shrunk cylinder overhang are shown as follows by way of example. The overhang was shrunk from an original dimension of about 0.45 inch. The shrunk film had:

1. Decreased in longitudinal length from 0.45 inch to 0.35 inch, a decrease of 22 percent.
2. Decreased in circumference from 25.23 inches to 23.36 inches, a decrease of 7.4 percent.
3. Increased in thickness to form a lip having a thickness, increasing with distance from the endring, of 0.010 inch to 0.013 inch (maximum, at point B in FIG. 2), an increase of 43 to 86 percent.
4. Formed a bead on the film edge of 0.015 to 0.02 inch thickness, giving a very tough, durable edge to the lip.

In order to achieve the shrinkage described above, it was ascertained that the 7-mil Mylar film utilized had to be uniformly heated to temperatures sufficiently high to cause the material to heat shrink the desired amount but yet be kept below a time-temperature relationship which would cause embrittlement of the film. Generally, this temperature is greater than 200° C., preferably about 220° C., but, as mentioned below, the embrittlement temperature of the film material. It is also noteworthy that the endring manufactured by P. Zimmer and which had a much greater surface area (which promoted rapid heat loss from the shrunk area) required a greater rotation rate than the relatively smaller endrings.

As stressed hereinbefore, the heat applied must be sufficient to adequately shrink the film but such shrinking must also be accomplished without embrittling or melting the plastic. (Temperatures of about 220° C were employed in the illustrative runs of Table 2). To put this constraint in perspective, Table 3 shows the shrinkage/temperature relationship for 7-mil Mylar.

TABLE 3

RELATIONSHIP OF SHRINK AND TEMPERATURE FOR 7-MIL MYLAR[a]

| Film Temp., ° C. | Shrinkage % Machine Direction | Shrinkage % Transverse Direction |
|---|---|---|
| 160 | 1.6 | 1.5 |
| 180 | 3.1 | 2.5 |
| 200 | 5.2 | 3.8 |
| 220 | 11 | 7 |
| 235 | Became brittle and shattered in less than one minute. | |
| 248 | Zero strength temperature. | |
| 250 | Melting point. | |

Other and further modifications and adaptations of the present invention may be made without departing from the spirit and scope of the invention as set forth with particularity in the appended claims.

We claim:

1. A rotary printing screen for mounting in a rotary screen printing machine having a tensioning device for longitudinally tensioning said rotary printing screen, comprising:

A. a pair of mutually parallel, coaxially disposed, and axially spaced endrings, each having a central rotational axis, an outer cylindrical surface, and an adjacent radially disposed shoulder extending toward said axis;

B. a screen cylinder which is coaxially aligned with said axis, having a central portion and a terminal portion at each end thereof, each said terminal portion being positioned over one of said outer cylindrical surfaces; and C. a pair of selectively heat-shrunk plastic support members, each of which is attached to one of said terminal portions and extends over said adjacent shoulder toward said axis as a radially recessed lip which increases progressively in thickness with distance from said cylindrical surface and terminates in a thickened bead, said support members uniformly resisting axially directed pressure from said longitudinal tensioning of said rotary printing screen and serving as a positive means to support the adjacent endrings in order to prevent cocking of said endrings within said screen cylinder and to prevent said endrings from being pulled out of said screen cylinder by said tensioning device.

2. The rotary screen of claim 1 wherein each said terminal portion is adhesively bonded to said one of said outer cylindrical surfaces to form an adhesive joint therebetween.

3. The rotary screen of claim 2 wherein each said plastic support member overlaps and is adhesively attached to one of said terminal portions and covers said joint therebeneath as a sleeve.

4. The rotary screen of claim 3 wherein said screen cylinder is made from metal and said sleeves are made from a heat-shrinkable polymer selected from the group consisting of polyesters and copolymers thereof.

5. The rotary screen of claim 2 wherein said support members are endwise extensions of said terminal portions, each said support member extending endwise beyond one said outer cylindrical surface for a distance of about 0.1 inch to 1.0 inch before heat shrinking thereof.

6. The rotary screen of claim 5 wherein said support members are made from a heat-shrinkable polymer selected from the group consisting of polyesters and copolymers thereof.

7. The rotary screen of claim 6 wherein said polymer is polyethylene terephthalate.

8. The rotary screen of claim 7 wherein each said lip is from about 10 to 90 percent thicker than said screen cylinder which has a thickness of 0.001 to 0.025 inch.

9. The rotary screen of claim 8 wherein each said lip is shrunk 5 to 10 percent in circumference and 10 to 35 percent in axial length.

10. A rotary printing screen, for use in rotary screen printing of textiles, which has a central rotational axis and comprises:

A. a pair of integrally constructed endrings which are spaced axially apart, are coaxially disposed and aligned with said central rotational axis, are mutually parallel and are selectively forced apart by axially directed pressure from a tension-applying means when said rotary printing screen is mounted and positioned in a rotary screen printing machine, each said endring comprising an outer cylindrical surface and an adjacent radially disposed shoulder extending radially inwardly from said surface; and B. a plastic cylinder, comprising:

1. a cylindrical portion that:
   a. is circumferentially under uniformly high tension when said screen is tensioned by said tension-applying means,
   b. has a terminal portion at each end thereof that fits over one said outer cylindrical surface, and
   c. is from 0.002 to 0.025 inch in thickness,
2. a pair of thickened lips, each said lip extending radially inwardly from one said terminal portion over a portion of one said shoulder so that all circumferentially related positions along said lip are equidistant from said axis, and
3. a beaded edge at the endwise edge of each said lip;

whereby said endrings obtain circumferentially uniform support from said lips against said axially directed pressure and do not become off centered in relation to said plastic cylinder during said rotary screen printing of textiles.

11. The rotary printing screen of claim 10 wherein said lips extend over said shoulder a distance of from about 0.1 to 1.0 inch.

12. The rotary printing screen of claim 11 wherein said lips are from about 10 to 90 percent thicker than said thickness of said cylindrical portion.

13. The rotary printing screen of claim 12 wherein said cylindrical portion has a thickness of 0.007 inch, said lip has a thickness of 0.010–0.013 inch, and said beaded edge has a thickness of 0.015–0.02 inch.

14. The rotary printing screen of claim 13 wherein said plastic cylinder is formed of polyethylene terephthalate and each said lip and each said beaded edge are heat shrunk so that said thickness thereof is circumferentially uniform and progressively increasing toward said beaded edge.

* * * * *